US007552888B2

(12) United States Patent
Glenn

(10) Patent No.: US 7,552,888 B2
(45) Date of Patent: Jun. 30, 2009

(54) KITE REEL

(76) Inventor: Gary O Glenn, 1869 Denver West Dr., #1734, Golden, CO (US) 80401

( * ) Notice: Subject to any disclaimer, the term of this patent is extended or adjusted under 35 U.S.C. 154(b) by 0 days.

(21) Appl. No.: 12/140,667

(22) Filed: Jun. 17, 2008

(65) Prior Publication Data

US 2009/0026301 A1 Jan. 29, 2009

Related U.S. Application Data

(60) Provisional application No. 60/951,767, filed on Jul. 25, 2007.

(51) Int. Cl.
*B65H 75/38* (2006.01)

(52) U.S. Cl. ..... 242/405; 242/405.2; 242/405.3; 242/588.2

(58) Field of Classification Search ..... 242/405, 242/405.1–405.3, 406, 558.2
See application file for complete search history.

(56) References Cited

U.S. PATENT DOCUMENTS 2,393,613 A * 1/1946 Combs ..... 242/395.1
2,585,263 A * 2/1952 Miller ..... 242/397
2,587,432 A * 2/1952 Bellah ..... 242/396.7
4,101,090 A * 7/1978 Wait, Jr. ..... 242/388.6
4,106,719 A * 8/1978 Haverland ..... 242/396.6
4,176,807 A 12/1979 Kwon
4,204,651 A * 5/1980 Haverland ..... 242/396.9
4,238,086 A * 12/1980 Brimmeier ..... 242/396.7
4,596,365 A * 6/1986 Wang ..... 242/396.4
4,747,561 A * 5/1988 Sweeny et al. ..... 242/396.3
6,402,075 B1 * 6/2002 Grimes ..... 242/395

* cited by examiner

*Primary Examiner*—Sang Kim
(74) *Attorney, Agent, or Firm*—Crossley Patent Law; Mark A. Crossley

(57) ABSTRACT

A kite reel device having a rectangular housing providing a cylindrical frame and a spool having ribs with a v-shaped outer edge, the spool being rotatably mounted onto a cylindrical axle located within a center aperture of the frame. A reel providing a handle is mounted to one side of the frame, while a knob for holding the device is affixed to the other side. Recesses within the frame releasably secure the handle to the frame. A hole in the center of the top side of the frame accommodates the passage of kite string onto the spool. The v-shape of the spool rib outer edges assists in keeping the kite string centered and from getting tangled around the axle. Another embodiment provides a ground anchor, a shoulder harness strap, a digital counter, a multiple gearing selector, and an electric power pickup. At least one replacement spool is also provided.

14 Claims, 7 Drawing Sheets

100
102
10B
22
21
140
140
FT. OUT
70
55
11
98
96
50
61
46
60
41
45
51
20
131a
62
28
43
48
144
90
131b
47
35
63
26
132b
144
30
132a
119
116
112
19
124
146
120
24
142
92
110
142
114
118
126
146
148
148
94
135
128
122
94
134a
154
156b
138a
156a
154
152
133b
133a
168
134b
170
152
138b
150
150
162
158
158
136a
166
164
160
166
136b
160
137
172

KITE REEL

This application claims the benefit of my previously filed U.S. Provisional Application No. 60/951,767 filed on Jul. 25, 2007.

FIELD OF THE INVENTION

The present invention relates to a reel assembly for winding cord and, more specifically to a kite reel device for controlling and maneuvering a kite.

BACKGROUND OF THE INVENTION

The present invention concerns that of a new and improved kite reel device having a rectangular housing providing a cylindrical frame and a spool having ribs with a v-shaped outer edge, the spool being rotatably mounted onto a portion of a cylindrical axle located within a center aperture of the frame. A reel providing a handle is mounted to one side of the frame, while a knob for holding the device is affixed to the other side of the frame. A first and second recess within the frame allow the reel handle to be releasably secured to the frame. A hole in the center of the top side of the frame accommodates the passage of kite string the top side and onto the spool. The v-shape of the outer edges of the spool ribs assists in keeping the kite string centered and in keeping the kite string from getting tangled or wrapped around the axle.

SUMMARY OF THE INVENTION

The present invention concerns that of a new and improved kite reel device having a rectangular housing formed of cylindrical tubing, said housing having a top side, bottom side, left side, right side and a center aperture. Said housing contains a spool with ribs having v-shaped outer edges, the spool being rotatably mounted onto a portion of a cylindrical axle located within said center aperture of said housing. Said axle continuously extends through a first opening on the left side of the housing, through the center aperture of said housing, and through a second opening on the right side of the housing. A handle for rotating the spool is affixed to a portion of said axle to the exterior of the left side of said housing. A knob is mounted to the exterior or the right side of said housing. A recess on each upper corner of the housing accommodates the releasable locking down of the handle. A hole in the center of the top side of the housing accommodates the feed of string from a kite through the top side and onto the spool. The v-shape of the spool ribs' outer edges assists in keeping the kite string centered, preventing slippage of the string, and in keeping the kite string from getting tangled or wrapped around the axle. A user of the present kite reel device enjoys a mechanical advantage over other kite reels in letting out and bringing in the kite because the reel lays the string on the spool at an elevated position. The present kite reel device is a platform for installing many kite flying options which are not possible with most, if not all, conventional kite reel devices, including a ground anchor, belly pack strap, shoulder harness, multiple gearing selector, electric power pickup, replacement spools, and digital counter. Another embodiment of the present device provides all of the foregoing elements. The ground anchor includes a step-on ground anchor to moor the kite reel to the ground, which allows continued flying of the kite without the kite flyer's actively flying or touching the device. The belly pack strap allows the use of a belly strap to secure the kite reel to the user's torso or other handy anchors, including trees, structures and so on. The shoulder harness may be used for anchoring the device to the body of the user to fly a kite. The multiple gearing selector allows a user to have multiple gearing selections in order to quickly retrieve a kite when a lot of line has been let out or when the wind dies. The electric power pickup allows a user to enjoy the use of a small electric motor to aid in reeling in a kite that is let out a considerable distance. A replacement spool is used to accommodate various sizes of string or cord, which may be used for various kite sizes, for various string or cord capacity, and for replacement of damaged or broken strings or cords. The digital counter, mounted on the device, records the amount of string let out when launching and flying a kite and the amount of string to bring in when reeling in a kite. The digital counter is rotatable to allow use by either a right-handed or left-handed user.

As such, the general purpose of the improved kite reel device which has all of the advantages of the prior art mentioned heretofore and many novel features that result in an improved kite reel device which is not anticipated, rendered obvious, suggested, or even implied by the prior art, either alone or in combination thereof.

An object of the present kite reel device is to prevent tangling or slippage of a kite string.

Another object of the present kite reel device is to provide a lightweight kite reel.

Yet another object of the present kite reel device is to provide a kite reel device which may be easily and efficiently manufactured and marketed.

Still another object of the present device is to provide a kite reel which is of durable and reliable construction.

Still yet another object of the present device is to provide a kite reel which is economically affordable and available for relevant market segment of the purchasing public.

Even still another object of the present device is to provide a kite reel which has all of the advantages of the prior art and none of the disadvantages.

Thus has been broadly outlined the more important features of the improved kite reel device so that the detailed description thereof that follows may be better understood and in order that the present contribution to the art may be better appreciated.

These together with additional objects, features and advantages of the improved kite reel device will be readily apparent to those of ordinary skill in the art upon reading the following detailed description of presently preferred, but nonetheless illustrative, embodiments of the improved kite reel device when taken in conjunction with the accompanying drawings. In this respect, before explaining the current embodiments of the improved kite reel device in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and kits for carrying out the several purposes of the improved kite reel device. It is therefore important that the claims be regarded as including such equivalent constructions insofar as they do not depart from the spirit and scope of the present invention.

Objects of the improved kite reel device, along with various novel features that characterize the invention are particularly pointed out in the claims forming a part of this disclosure. For better understanding of the improved kite reel device, its operating advantages and specific objects attained by its uses, refer to the accompanying drawings and description.

DETAILED DESCRIPTION OF THE DRAWINGS

Figure 1:
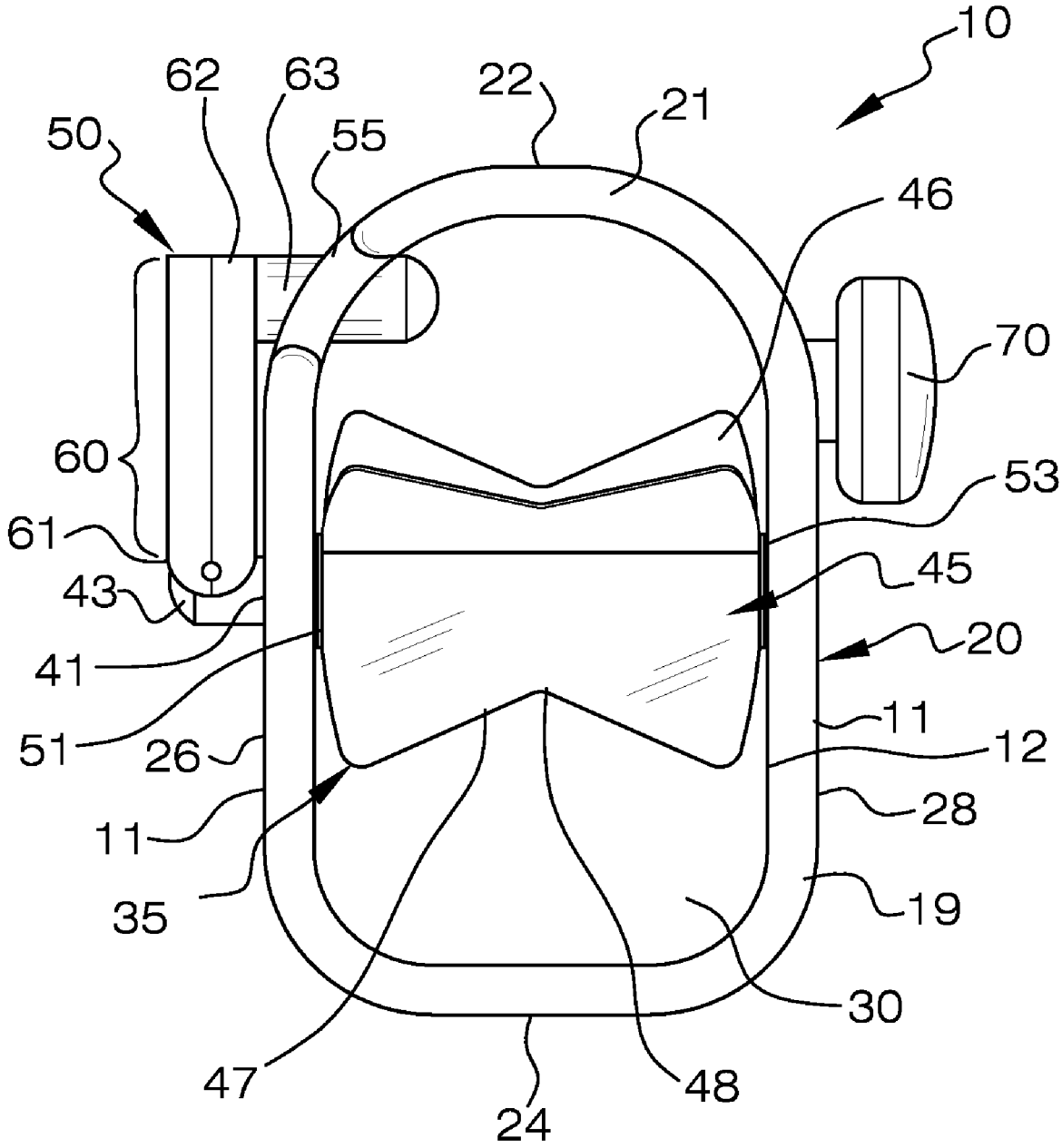
FIG. 1 is a front elevation view a first embodiment.
Figure 2:
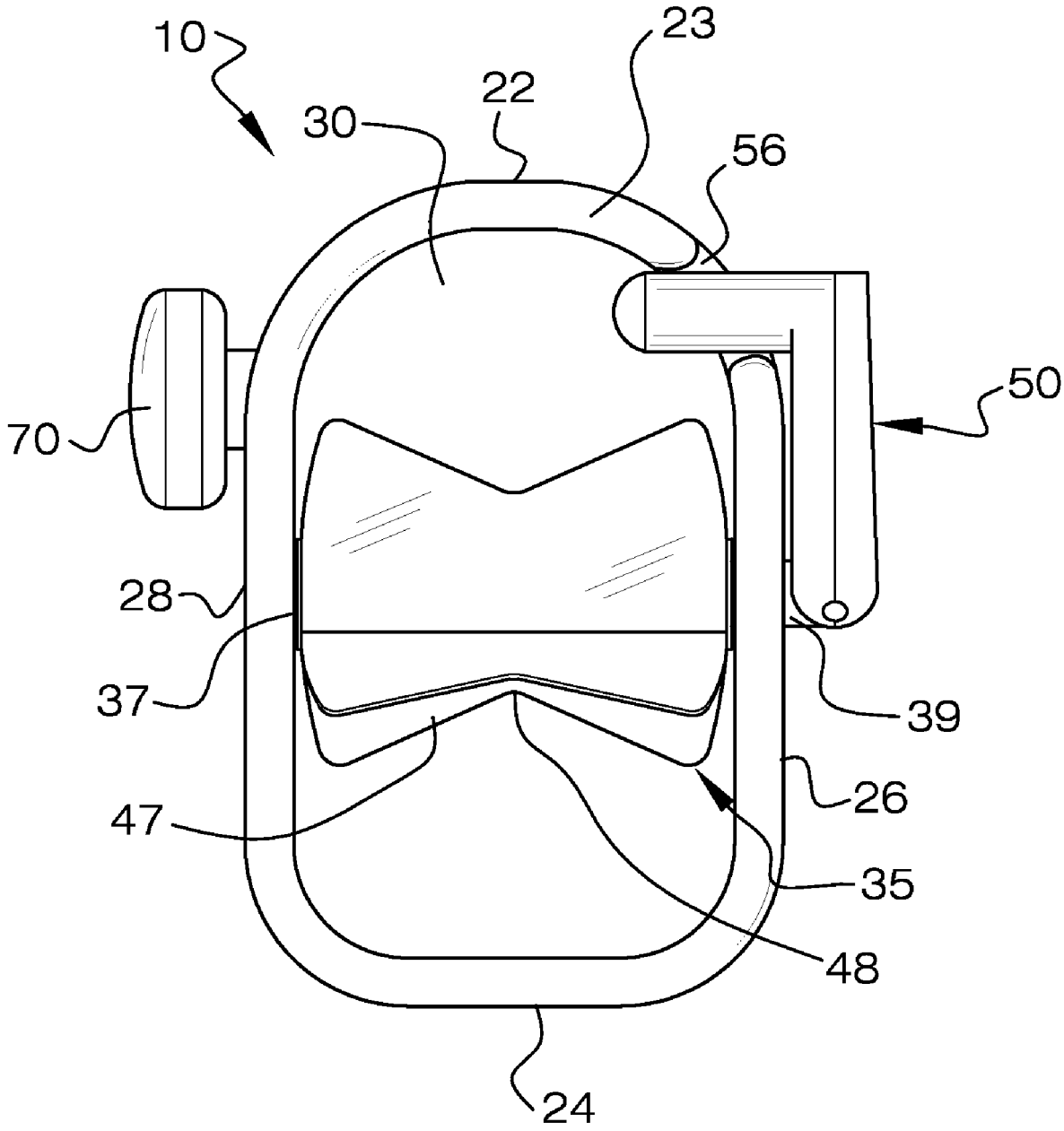
FIG. 2 is a rear elevation view thereof.
Figure 3:
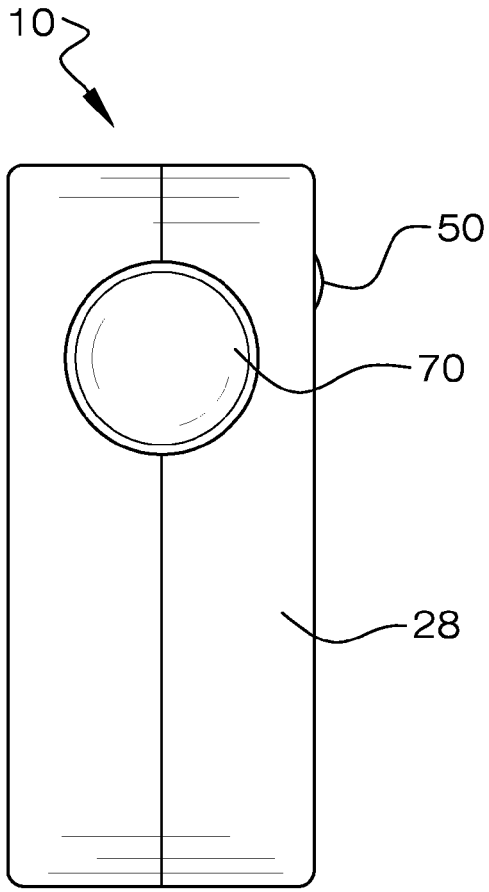
FIG. 3 is a right elevation view thereof.

With reference now to the drawings, and in particular FIGS. 1 through 9 thereof, examples of the kite reel employing the principles and concepts of the present kite reel device, generally designated by the reference number 10, will be described.

Referring to FIGS. 1 through 8, the present kite reel device 10 is designed for a kite having kite string attached thereto. The present device 10 provides a rectangular housing 20, a spool 35, a reel 50, and a knob 70. The housing 20, reel 50 and handle are formed, for example, from polymer, plastic, wood, metal or other suitable lightweight, durable materials. The housing 20 is a cylindrical frame 19 having an exterior wall 11, an interior wall 12, a front side 21, a rear side 23, a top side 22, a bottom side 24, left side 26, a right side 28 and a center aperture 30 defined by said top side 22, said bottom side 24, said left side 26, and said right side 28. The frame 19 also has a first opening 41 through the center of the left side 26. The first opening 41 accommodates the passage of an axle 39 therethrough. The frame 19 further provides a first recess 55 within the front side 21 of the frame 19 positioned adjacent to the top side and the left side and a second recess 56, which mirrors the first recess 55, within the rear side positioned adjacent to the top side and left side. The first recess 55 and the second recess 56 selectively releasably secure a handle 63 to the frame 19. The frame 19 also provides a hole 57 running continuously through the center of the top side. The hole 57 accommodates the passage of kite string attached to a kite, through the top side 22 of the frame 19 and onto a spool 35.

The device 10 further provides a spool 35 positioned horizontally within and extending across the center aperture 30 of the frame 19. The spool 35 continuously extends from the interior wall 12 on the right side 28 of the frame 19, through the center aperture 30, and to the interior wall 12 on the left side 26. The spool 35 further has a first end flange 51 between the spool 35 and the interior wall 12 on the left side 26 and a second end flange 53 between the spool 35 and the interior wall 12 on the right side 28. The spool 35 has a cylindrical axial central bore 37 running continuously therethrough. The bore 37 receives a cylindrical axle 39 therethough. The axle 39 rotatably supports the spool 35. The axle 39 continuously extends from the interior wall 12 on the right side 28 of the frame 19, through the second end flange 53, through the bore 37, through the first end flange 51, through the first opening 41 on the left side 26 protruding horizontally from the exterior wall 11 on the left side 26, and terminating at a distal end 43. A plurality of longitudinally extending ribs 45 extends from the spool 35. Each extending rib 45 is a flat plate 46 extending between the first end flange 51 and the second end flange 53, each plate 46 having an outer edge 47. The outer edge 47 has a v-shaped center point 48. The center point 48 guides kite string toward the center of the spool 35 thereby preventing entanglement of the kite string. The spool 35 and center point 48 allows the reel to lay kite string or cord on the spool at an elevated position which makes letting out and reeling in the kite easier than with conventional kite reel devices.

A reel 50 rotates the axle 39 and thereby rotates the spool 35. The reel has a body 60 having a lower end 61 pivotally affixed to the distal end 43 of the axle 39 and an upper end 62. A handle 63 perpendicularly extends from said upper end 62. The reel 50 body 60 selectively pivots outwardly away from the frame 19 to allow rotation of the axle 39 which thereby, in turn, rotates the spool 35. The body 60 also selectively pivots inwardly toward the frame 19 to allow the handle 63 to be releasably secured to either the first recess 55 or the second recess 56 of the frame 19 as a user desires.

Figure 4:
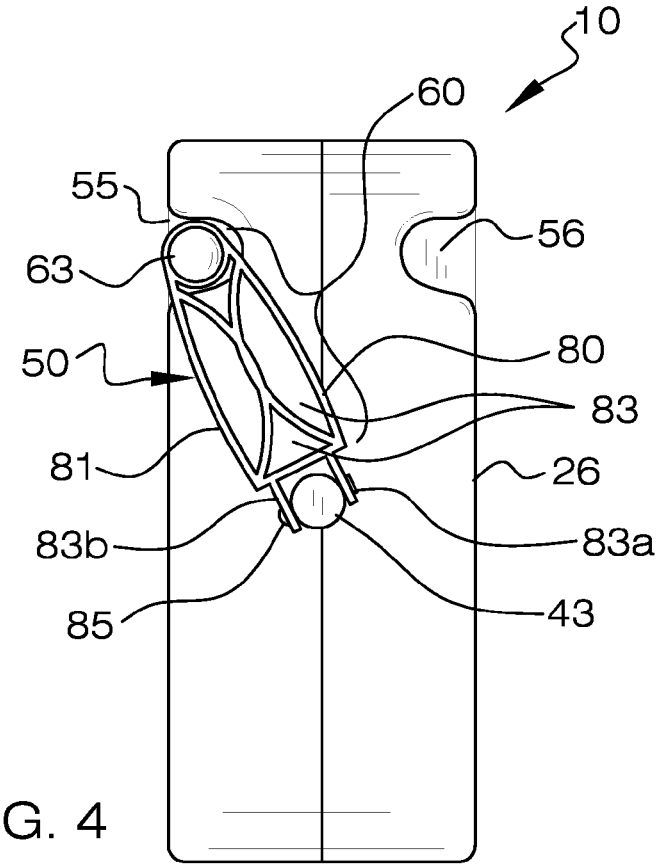
FIG. 4 is a left elevation view thereof.
Figure 5:
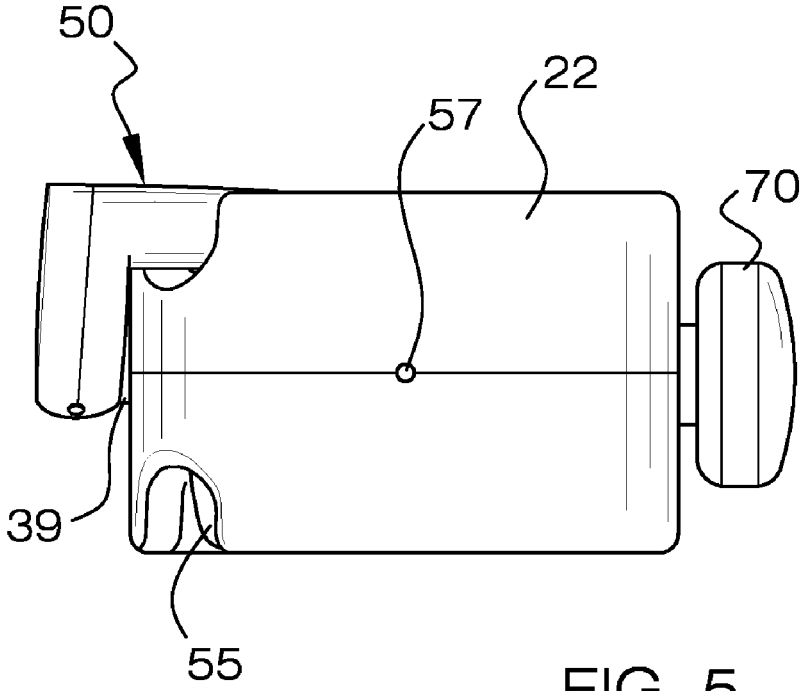
FIG. 5 is a top plan view thereof.
Figure 6:
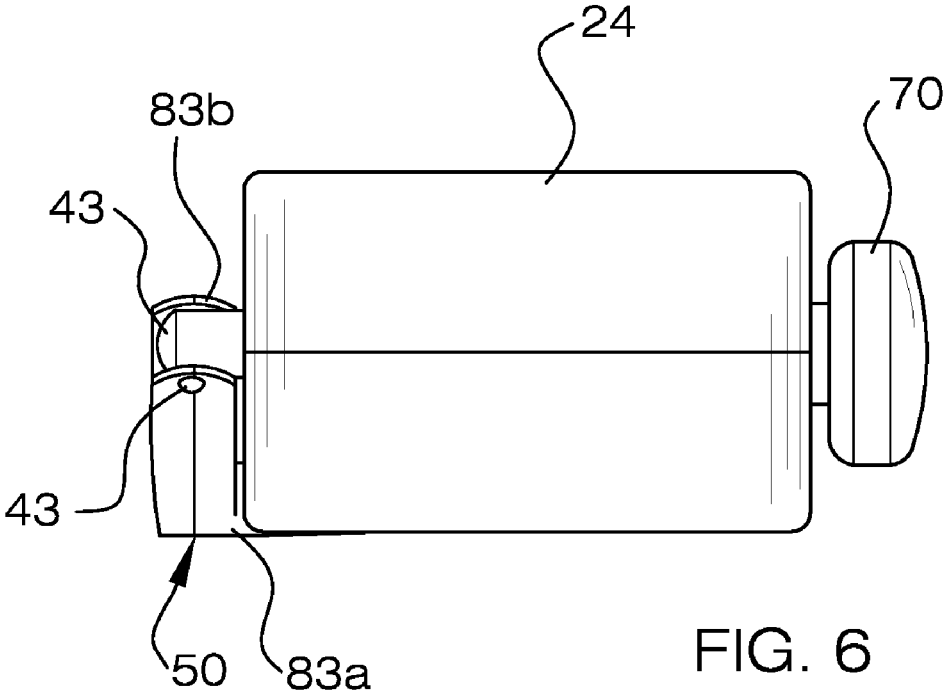
FIG. 6 is a bottom plan view thereof.
Figure 7:
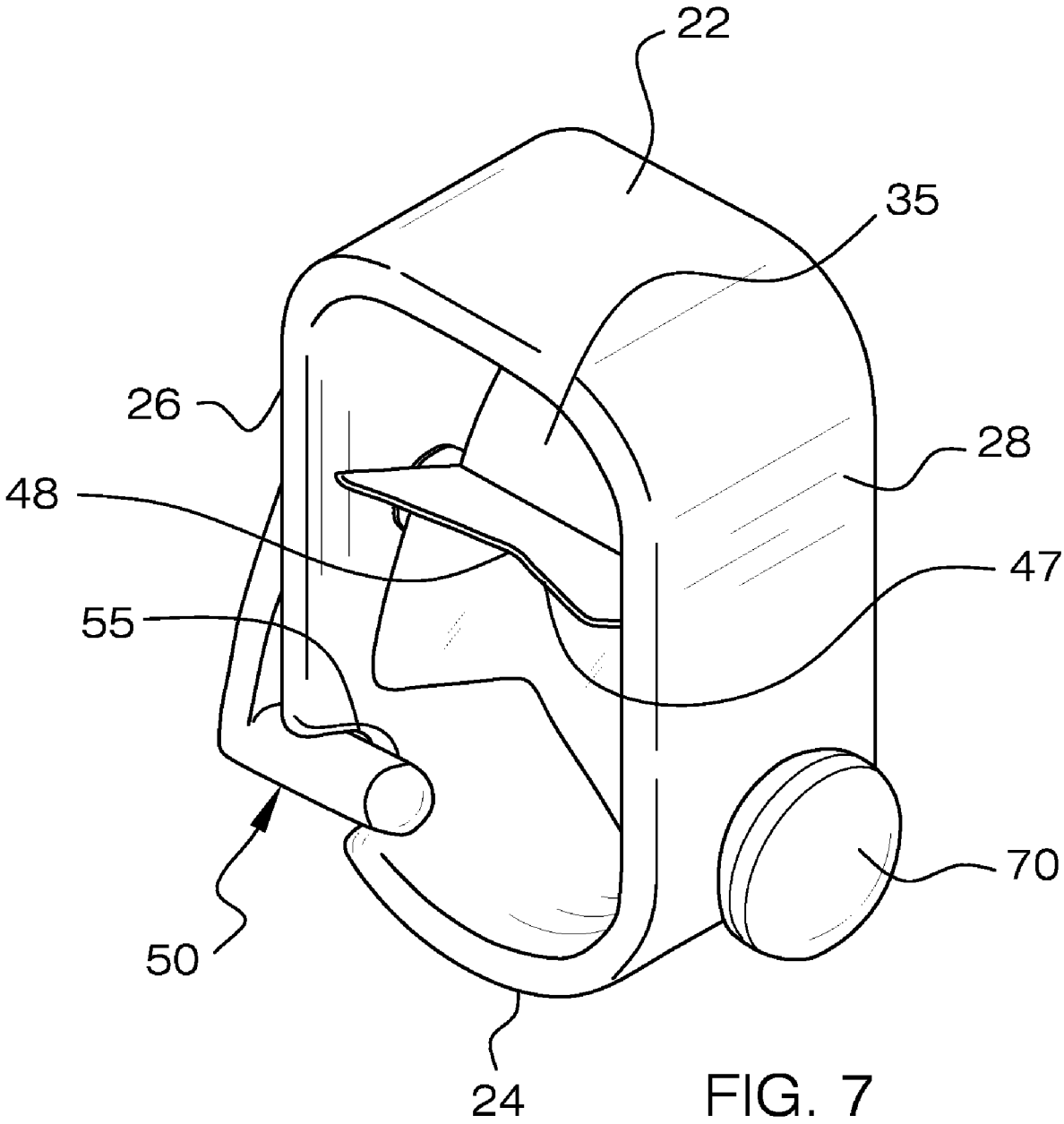
FIG. 7 is right side isometric view thereof.
Figure 8:
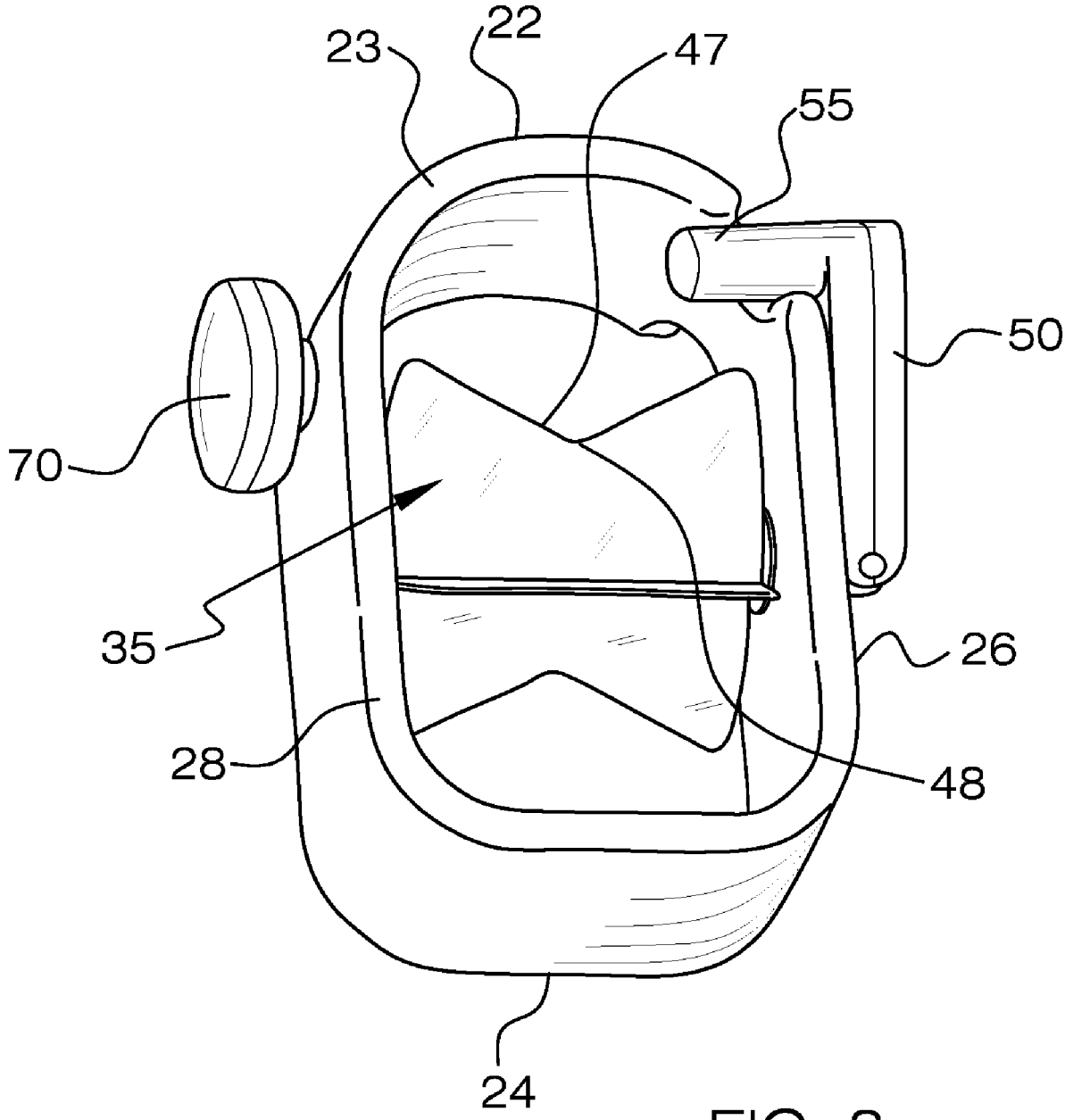
FIG. 8 is a rear isometric view thereof.

The body 60 may have a slightly convex front edge 80, a slightly convex rear edge 81, a center portion 82 divided into open sections 83 as shown in FIG. 4. The open sections 83 make the device 10 lighter than solid sections, thereby making the device 10 easier to handle than other kite reels. The convex shape of the front edge 80 and the rear edge 81 make the device 10 easier to grasp than would be the case if the front edge 80 and the rear edge 81 were another shape. FIG. 4 also illustrates a pivoting means which may be two perpendicular parallepiped pivot extensions 83*a*, 83*b* which extend outwardly from the body 60 toward the distal end 43 and are secured via a securing pin 85 to the distal end 43.

A knob 70 to grasp the present kite reel 10 is mounted to the right side 28 of the housing 20. A recess 55 on the front side 21 between the top side 22 and left side 26 and another recess 55 on the rear side 23 between the top side 22 and right side 28 of the housing 20 releasably secures the handle 50 to the housing 20. A hole 57 in the center of the top side 22 of the housing 20 accommodates the feed of string from a kite through the top side 22 and onto the spool 35. The v-shaped outer edge 47 of the spool ribs 45 assists in keeping the kite string centered and in keeping the kite string from getting tangled or wrapped around the axle 39.

Figure 9:
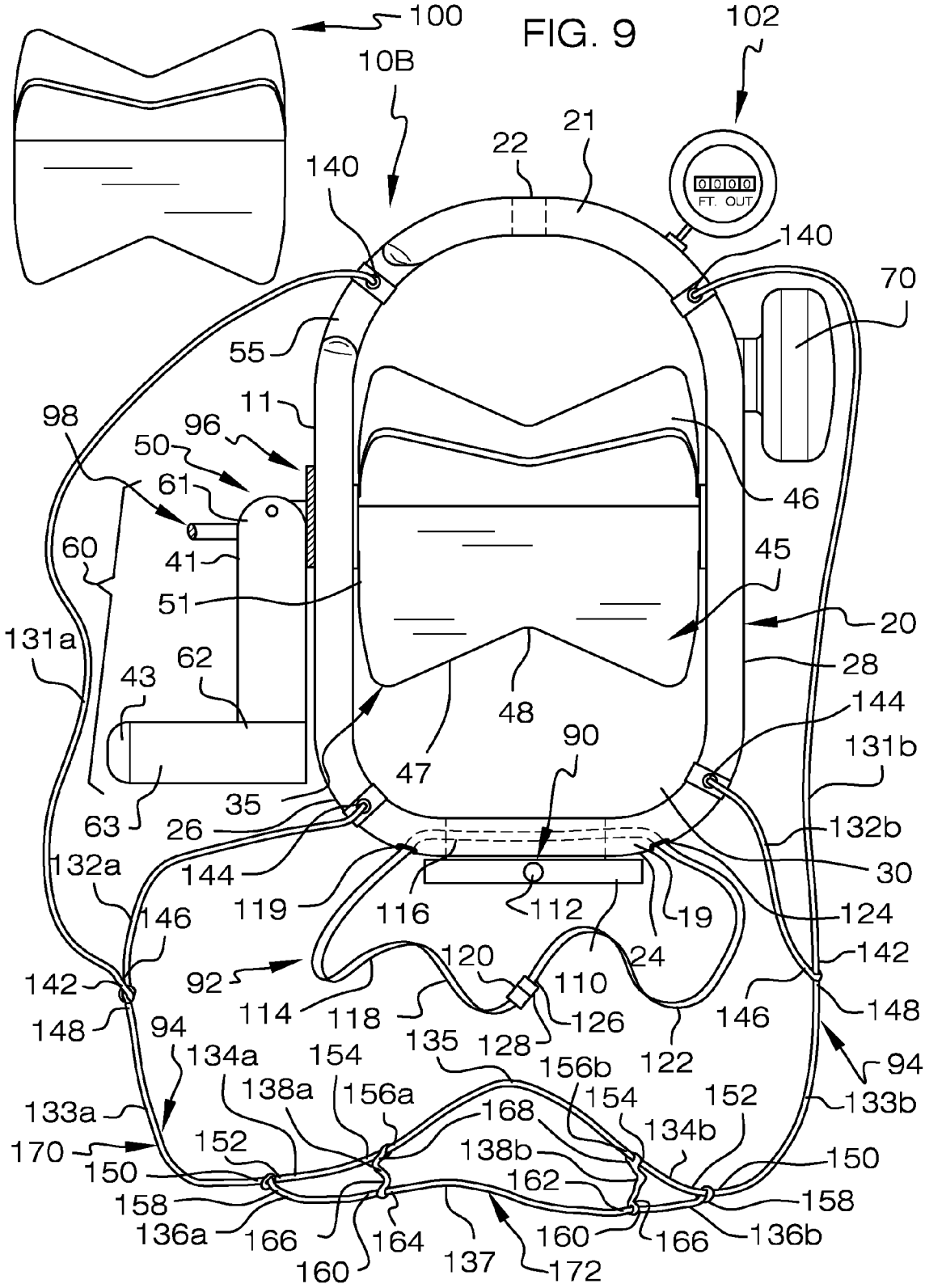
FIG. 9 is a front isometric view of another embodiment.

FIG. 9 illustrates another embodiment of the present kite reel device 10B. FIG. 9 is identical to the embodiment of the present kite reel device 10 shown in FIGS. 1 through 8 except that this embodiment 10B provides additional components and the frame 19 is hollow. This embodiment 10B provides a platform for installing many kite flying options which are not possible with most, if not all, conventional kite reel devices, including a ground anchor 90, a belly pack strap 92, a shoulder harness 94, a multiple gearing selector 96, an electric power pickup 98, at least one replacement spool 100, and a digital counter 102. The ground anchor 90 provides a step-on ground anchor to moor the kite reel 10B to the ground, which allows continued flying of a kite without the kite flyer's actively flying, or touching, the device 10B. The ground anchor 90 comprises a base 110 outwardly extending from the exterior wall 11 along the bottom side 24 of the frame 19. The ground anchor 90 further comprises a round orifice 112 passing through the center of the base 110. The orifice 112 accommodates the passage of string or cord therethrough whereby the device 10B is anchored to the ground. The base 110 may be parallelepiped as shown in FIG. 9 or other 3-dimensional shape which accommodates the functionality of the base 110. The belly pack strap 92 secures the kite reel device 10B to a user's torso or other handy anchors, including trees, structures, and so on. The belly pack strap 92 is a length of cord 114 having a first section 116, a second section 118 having a first connection end 119 and a second connection end 120, and a third section 122 having a third connection end 124 and a fourth connection end 126. The first section 116 is permanently affixed within the bottom side 24 of the hollow frame 19. The first connection end 119 of the second section 118 is affixed to one end of the first section 116 and continuously runs through the exterior wall 11 between the bottom side 24 and the left side 26 of the frame 19. The third connection end 124 of the third section 120 is affixed to the opposite end of the first section 116, and runs through the exterior wall 11 between the bottom side 24 and the right side 28 of the frame 19. The second connection end 126 of the second section 120 and the fourth connection end 126 of the third section 122 are removably adjoined via an adjoinment means 128, which may include a clip, as shown in FIG. 9, or hook and loop fastening, or other fastener. The shoulder harness 94 may be used for anchoring the device 10B to the body of a user to fly a kite. The shoulder harness 94 provides various lengths of cord provided in an identical pair of extended segments 131*a*, 131*b*; an identical pair of middle segments 132*a*, 132*b*; an identical pair of bottom segments 133*a*, 133*b*; an identical pair of connecting segments 134*a*, 134*b*; a central segment 135; an identical pair of lower segments 136*a*, 136*b*; an inner segment 137; and an identical pair of inter-connecting segments 138*a*, 138*b*.

Each of the extended segments 131*a*, 131*b* have a mounting end 140 attached to the exterior wall 11 of the frame 19 between the top side 22 and the left side 26 and between the top side 22 and the right side 28, respectively and a linking end 142. Each of the middle segments 132*a*, 132*b* have an affixment end 144 attached to the exterior wall 11 of the frame between the bottom side 24 and the left side 26 and the bottom side 24 and the right side 28 and an attachment end 146. The linking end 142 of each of the extended segments 131*a*, 131*b* is joined to the attachment end 146 of each of the middle segments 132*a*, 132*b*, respectively. Each of the bottom segments 133*a*, 133*b* has a securement end 148 and a joining end 150. The securement end 148 of each bottom segment 133*a*, 133*b* is also joined to the attachment end 146 of the middle segments 132*a*, 132*b*, respectively. The connecting segments 134*a*, 134*b* each have a fastening end 152 and an appendment end 154. The fastening end 152 is adjoined to the joining end 150. The central segment 135 has a first adjoinment end 156*a* and a second adjoinment end 156*b* wherein the first adjoinment end 156*a* is joined to the appendment end 154 of connecting segment 134*a* and the second adjoinment end 156*b* is joined to the appendment end 154 of connecting segment 134*b*. Each of the lower segments 136*a*, 136*b* have an outer end also attached to the fastening end 152 and have an inner end 160. The inner segment 137 has a right end 162 attached to an inner end 160 of the lower segment 136*b* and a left end 164 attached to an inner end 160 of the lower segment 136*a*. Each inter-connecting segment 138*a*, 138*b* has a lower tip 166 and an upper tip 168. The lower tip 166 of inter-connecting segment 138*a* is attached to the left end 164 of the inner segment 137. The lower tip 166 of inter-connecting segment 138*b* is attached to the right end 162 of the inner segment 137. The upper tip 168 of inter-connecting segment 138*a* is attached to the first adjoinment end 156*a* of the central segment 135. The upper tip 168 of inter-connecting segment 138*b* is attached to the second adjoinment end 156*b* of the central segment 135. The inter-connecting segments 138*a*, 138*b* run vertically between the central segment 135 and inner segment 137.

A first loop 170 is formed by middle segments 132*a*, 132*b*, bottom segments 133*a*, 133*b*, connecting segments 134*a*, 134*b*, and central segment 135. A second loop 172 is formed by the connecting segments 1334*a*, 134*b* and central segment 135 of the first loop 170, as well as the lower segments 136*a*, 136*b*, and the inner segment 137. The perimeter of the second loop 172 is shorter than the perimeter of the first loop 170.

The length of each middle segment 132*a*, 132*b* and the combined length of each bottom segment 133*a*, 134*a* and each connecting segment 134*a*, 134*b* are approximately equal. The length of each extended segment 131*a*, 131*b* is approximately equal to twice the length of each middle segment 132*a*, 132*b*. The central segment 135 is approximately equal in length to one of the bottom segments 133*a*, 133*b*. The length of each lower segment 136*a*, 136*b* is approximately the same length as the length of one of the connecting segments 134*a*, 134*b*. The length of the inner segment 137 is approximately the same length as the central segment 135. The length of each of the inter-connecting segments 138*a*, 138*b* is approximately one-half the length of one of the lower segments 136*a*, 136*b*.

The multiple gearing selector 96 allows a user to have multiple gearing selections in order to quickly retrieve a kite when a lot of line has been let out or when the wind dies. The multiple gearing selector 96 is attached to the 39 axle of the device 10B between the exterior wall 11 and handle 50.

The electric power pickup 98 allows a user to enjoy the use of a small electric motor to aid in reeling in a kite that is let out a considerable distance. The electric power pickup 98 engages the axle 39 to spin the spool 35 to launch a kite or to reel a kite back in.

At least one replacement spool 100 is provided to accommodate various sizes of string or cord, which may be used for various kite sizes, for various string or cord capacity, and for replacement of damaged or broken strings or cords. The replacement spool 100.

The digital counter 102 operatively engages the axle 39 to record and display the amount of string or cord let out when launching and flying a kite and the amount of string or cord to bring in when reeling in a kite. The digital counter 102 provides a display member, which is mounted to the exterior wall 11 of the device 10B, to selectively display the amount of string let out when launching and flying a kite and the amount of string or cord to bring in when reeling in a kite.

For left-handed users, the positions of the knob 70 and reel 60 may be reversed.

With respect to the above description then, it is to be realized that the optimum dimensional relationships for the parts of the kite reel device 10 and other embodiments thereof, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A kite reel device for a kite having kite string attached thereto, said device comprising, in combination:

a length of kite string;

a rectangular housing comprising:

a cylindrical frame having an exterior wall, an interior wall, a front side, a rear side, a top side, a bottom side, a left side, a right side, a center aperture defined by said top side, said bottom side, said left side and said right side, said frame comprising:

a first opening through the center of said left side wherein said first opening accommodates the passage of an axle therethrough;

a first recess within said front side positioned adjacent to said top side and said left side wherein said first recess selectively releasably secures a handle to said frame;

a second recess on said rear side positioned between said top side and said right side wherein said second recess selectively releasably secures said handle to said frame;

a hole running continuously through the center of said top side, wherein said hole accommodates the passage of kit string from said kite through said top side and onto a spool;

said spool comprising:

a first end flange between said spool and said interior wall on said left side;

a second end flange between said spool and said interior wall on said right side;

wherein said spool extends horizontally across said center aperture, said spool continuously extending from said interior wall on said right side, through said center aperture, and to said interior wall on said left side;

a cylindrical axial central bore running continuously through said spool, wherein said bore receives said axle therethrough;

a plurality of longitudinally extending ribs, each rib comprising:

a plate extending between said first end flange and said second end flange, said plate having an outer edge;

a v-shaped center point in said outer edge, wherein said center point guides kite string toward the center of said spool thereby preventing entanglement of kite string;

said axle continuously extending from said interior wall on said right side, through said second end flange, through said bore, through said first flange, through said first opening on said left side, protruding horizontally from said exterior wall on said left side, and ending at a distal end, said axle rotatably supporting said spool;

a reel comprising:

a body having a lower end pivotally affixed to said distal end of said axle and an upper end, wherein said body pivots outwardly away from said frame thereby allowing said reel to rotate said axle, thereby rotating said spool and further wherein said body pivots inwardly toward said frame; and said handle perpendicularly extending from said upper end, wherein said handle is selectively releasably secured to said first recess and said second recess; and a knob extending outwardly from said right side of said frame in alignment with said reel.

2. The kite reel device of claim 1 wherein the body of said reel comprises:

a slightly convex front edge, a slightly convex rear edge, a center portion divided into open sections; and a pivoting means comprising two perpendicular parallelepiped pivot extensions which extend outwardly from the body toward the distal end and are secured via a securing pin to the distal end.

3. The kite reel device of claim 2 wherein said housing, said reel and said knob are formed from polymer.

4. The kite reel device of claim 2 wherein said housing, said reel and said knob are formed from plastic.

5. The kite reel device of claim 1 wherein said housing, said reel, and said knob are formed from polymer.

6. The kite reel device of claim 1 wherein said housing, said reel and said knob are formed from plastic.

7. The kite reel device for a kite having kite string attached thereto, said device comprising, in combination:

a length of kite string;

a rectangular housing comprising:

a cylindrical hollow frame having an exterior wall, an interior wall, a front side, a rear side, a top side, a bottom side, a left side, a right side, a center aperture defined by said top side, said bottom side, said left side and said right side, said frame comprising:

a first opening through the center of said left side wherein said first opening accommodates the passage of an axle therethrough;

a first recess within said front side positioned adjacent to said top side and said left side wherein said first recess selectively releasably secures a handle to said frame;

a second recess on said rear side positioned between said top side and said right side wherein said second recess selectively releasably secures said handle to said frame;

a hole running continuously through the center of said top side, wherein said hole accommodates the passage of said kite string through said top side and onto a spool;

said spool comprising:

a first end flange between said spool and said interior wall on said left side;

a second end flange between said spool and said interior wall on said right side;

wherein said spool extends horizontally across said center aperture, said spool continuously extending from said interior wall on said right side, through said center aperture, and to said interior wall on said left side;

a cylindrical axial central bore running continuously through said spool, wherein said bore receives said axle therethrough;

a plurality of longitudinally extending ribs, each rib comprising:

a plate extending between said first end flange and said second end flange, said plate having an outer edge;

a v-shaped center point in said outer edge, wherein said center point guides said kite string toward the center of said spool thereby preventing entanglement of said kite string;

said axle continuously extending from said interior wall on said right side, through said second end flange, through said bore, through said first end flange, through said first opening on said left side, protruding horizontally from said exterior wall on said left side, and ending at a distal end, said axle rotatably supporting said spool;

a reel comprising:

a body having a lower end pivotally affixed to said distal end of said axle and an upper end, wherein said body pivots outwardly away from said frame thereby allowing said reel to rotate said axle, thereby rotating said spool and further wherein said body pivots inwardly toward said frame; and said handle perpendicularly extending from said upper end, wherein said handle is selectively releasably secured to said first recess and said second recess;

a knob extending outwardly from said right side of said frame in alignment with said reel;

a ground anchor having a base outwardly extending from said exterior wall along said bottom side of said frame and a round orifice passing through said base;

a belly pack strap comprising a length of cord having a first section, a second section having a first connection end and a second connection end, a third section having a third connection end and a fourth connection end, wherein the first section is permanently affixed within said bottom side of said frame, said first connection end is affixed to one end of said first section and continuously runs through said exterior wall between said bottom side and said left side of said frame, further wherein the third connection end is affixed to the opposite end of said first section and runs through said exterior wall between said bottom side and said right side of said frame; even further wherein said second connection end and said fourth connection end are removably adjoined via an adjoinment means;

a shoulder harness comprising a plurality of cord lengths comprising:

an identical pair of extended segments, each extended segment having a mounting end, one mounting end attached to said frame exterior wall between said top side and said right side and the other mounting end attached to said frame exterior wall between said top side and said left side and each extended segment further having a linking end;

an identical pair of middle segments, each middle segment having an affixment end and an attachment end, wherein one affixment end is attached to said frame exterior wall between said bottom side and said left side and the other affixment end is attached to said frame exterior wall between said bottom side and said right side and further wherein each middle segment attachment end is attached to said corresponding linking end;

an identical pair of bottom segments, each bottom segment having a securement end and a joining end, wherein each securement end is attached to said corresponding attachment end;

an identical pair of connecting segments, each connecting segment having a fastening end and an appendment end, wherein each fastening end is attached to said corresponding joining end;

a central segment having a first adjoinment end and a second adjoinment end, wherein said first adjoinment end is joined to said corresponding appendment end and wherein said second adjoinment end is joined to a corresponding appendment end;

an identical pair of lower segments, each lower segment having an outer end and an inner end, wherein each outer end is attached to said corresponding fastening end;

an inner segment having a right end and a left end, wherein said right end is attached to one inner end and said left end is attached to the other inner end;

an identical pair of inter-connecting segments, each inter- connecting segment having a lower tip and an upper tip, wherein one of said lower tip is attached to said left end and the other lower tip is attached to said right end and wherein one of said upper tip is attached to said first adjoinment end and the other of said upper tip is attached to said second adjoinment end whereby said inter-connecting segments run vertically between said central segment and said inner segment;

a multiple gearing selector attached to said axle between said exterior wall and said handle wherein said multiple gearing selector allows a user to selectively use a gear;

an electric power pickup engaging said axle, wherein said electric power pickup spins said spool, whereby the length of a kite string is selectively changed to control a kite;

a digital counter having a display member, said digital counter operatively engaging said axle wherein said digital counter records and displays the length of kite string.

8. The kite reel device of claim 7 wherein the body of said reel comprises:

a slightly convex front edge, a slightly convex rear edge, a center portion divided into open sections; and a pivoting means comprising two perpendicular parallepiped pivot extensions which extend outwardly from the body toward the distal end and are secured via a securing pin to the distal end.

9. The kite reel device of claim 8 further comprising at least one replacement spool.

10. The kite reel device of claim 8 wherein said housing, said reel and said knob are formed from polymer.

11. The kite reel device of claim 8 wherein said housing, said reel and said knob are formed from plastic.

12. The kite reel device of claim 7 further comprising at least one replacement spool.

13. The kite reel device of claim 7 wherein said housing, said reel, and said knob are formed from polymer.

14. The kite reel device of claim 7 wherein said housing, said reel and said knob are formed from plastic.

* * * * *